US009115615B2

(12) United States Patent
Cook et al.

(10) Patent No.: US 9,115,615 B2
(45) Date of Patent: Aug. 25, 2015

(54) LUBRICATING OIL COMPOSITION WITH ANTI-MIST ADDITIVE

(75) Inventors: Stephen J. Cook, Belper (GB); Alexandra Mayhew, Wirksworth (GB); Mark C. Davies, Belper (GB); Jolanta Z. Adamczewska, Derby (GB)

(73) Assignee: The Lubrizol Corporation, Wickliffe, OH (US)

( * ) Notice: Subject to any disclaimer, the term of this patent is extended or adjusted under 35 U.S.C. 154(b) by 219 days.

(21) Appl. No.: 13/877,354

(22) PCT Filed: Oct. 5, 2011

(86) PCT No.: PCT/US2011/054842

§ 371 (c)(1), (2), (4) Date: Jun. 26, 2013

(87) PCT Pub. No.: WO2012/047949

PCT Pub. Date: Apr. 12, 2012

(65) Prior Publication Data

US 2013/0263807 A1 Oct. 10, 2013

Related U.S. Application Data

(60) Provisional application No. 61/390,237, filed on Oct. 6, 2010.

(51) Int. Cl.
*F01M 11/00* (2006.01)
*C10M 165/00* (2006.01)

(52) U.S. Cl.
CPC ..... *F01M 11/00* (2013.01); *C10M 165/00* (2013.01); *C10M 2203/1006* (2013.01); *C10M 2205/026* (2013.01); *C10M 2205/0285* (2013.01); *C10M 2207/028* (2013.01); *C10M 2219/046* (2013.01); *C10N 2220/021* (2013.01); *C10N 2230/04* (2013.01); *C10N 2230/30* (2013.01); *C10N 2230/42* (2013.01); *C10N 2230/43* (2013.01); *C10N 2230/45* (2013.01); *C10N 2240/102* (2013.01); *C10N 2240/104* (2013.01)

(58) Field of Classification Search
CPC ..... C10M 129/10; C10M 129/26; C10M 129/34; C10M 159/24; C10M 159/22; F01M 11/00
See application file for complete search history.

(56) References Cited

U.S. PATENT DOCUMENTS

| | | | | |
|---|---|---|---|---|
| 6,034,039 | A | 3/2000 | Gomes et al. | |
| 2002/0119896 | A1 * | 8/2002 | Yagishita et al. | 508/291 |
| 2004/0198614 | A1 | 10/2004 | Calder et al. | |
| 2005/0215441 | A1 | 9/2005 | Mackney et al. | |
| 2006/0052252 | A1 | 3/2006 | Wedlock et al. | |
| 2006/0172896 | A1 | 8/2006 | Conroy et al. | |
| 2008/0188386 | A1 | 8/2008 | Burrington | |

FOREIGN PATENT DOCUMENTS

| | | |
|---|---|---|
| EP | 0331359 | 9/1989 |
| GB | 1422204 | 1/1976 |
| WO | 94/21760 | 9/1994 |
| WO | 2005/061682 | 7/2005 |

OTHER PUBLICATIONS

Corresponding PCT Publication No. WO 2012/047949 A1 and Search Report published Apr. 12, 2012.
Written Opinion of corresponding International Application No. PCT/US2011/054842 completed Dec. 15, 2011.

* cited by examiner

*Primary Examiner* — Lindsay Low
*Assistant Examiner* — Jacob Amick
(74) *Attorney, Agent, or Firm* — David M. Shold

(57) ABSTRACT

A lubricating composition containing an oil of lubricating viscosity, a high molecular weight polyolefin that is at least substantially free of ethylene-derived monomer units, and an overbased metal containing detergent, is capable of reducing intake valve deposits in a direct injection engine.

18 Claims, No Drawings

LUBRICATING OIL COMPOSITION WITH ANTI-MIST ADDITIVE

FIELD OF INVENTION

The present invention relates to a lubricating composition containing an oil of lubricating viscosity, a high molecular weight polyolefin that is at least substantially free of ethylene-derived blocks, and an overbased metal containing detergent capable of reducing intake valve deposits in a direct injection engine.

BACKGROUND OF THE INVENTION

Direct injection engines are engines wherein fuel injection occurs inside the engine's cylinders. Injection of the fuel in this manner allows for more precise control over fuel consumption. Direct injection reduces cylinder temperature and improves air-fuel mixing allowing for greater power, improved emissions, and improved fuel economy. However, engines of this type are also very prone to inlet (also called intake) valve deposits (IVD). These deposits can interfere with valve closing, valve motion, and valve sealing, which reduces the efficiency of the engine and limits maximum power.

U.S. Patent application 2004/0198614, Calder et al., Oct. 7, 2004, discloses a method of reducing intake valve deposits (or inlet valve deposits, IVD) by utilizing a lubricating composition wherein the base oil contains combinations of Group III and/or Group IV base oils in combination with Group V synthetic ester base fluids.

U.S. Patent application 2006/0052252, Wedlock et al., Mar. 9, 2006, discloses a method for lubricating a gasoline direct injection (GDI) engine with a lubricant containing a combination of low viscosity base oil derived from a Fischer-Tropsch process and a high viscosity oil also derived from a Fischer-Tropsch process.

U.S. Patent application 2005/215441, Mackney et al., Sep. 29, 2005, discloses a method of operating a direct injection engine having an exhaust gas recirculation system by introducing via the fuel an ashless detergent that results in improved performance of the lubricant.

U.S. Patent application 2006/0172896, Conroy et al., Aug. 3, 2006, discloses a method of reducing the occurrence of ring-sticking in an internal combustion engine by using a lubricant containing a relatively large amount (1-15% wt) of a low molecular weight (Mn 100 to 5000) olefin polymer, especially polyisobutylene.

U.S. Pat. No. 6,034,039, Gomes et al., Mar. 7, 2000, discloses complex overbased detergents made up of combinations of sulfonate and phenate soap that provide enhanced corrosion and deposit control.

WO/PCT application 2005/061682, Wilby et al., Aug. 23, 2006, discloses lubricant formulations containing detergent compositions and dispersants designed for improving cleanliness and deposit control. Detergents derived from alkyphenols provide especially good cleanliness.

Olefin copolymers are well known as viscosity modifiers in lubricant compositions. They can be used to improve viscosity index, provide thickening of the composition, or allow for the formulation of multi-grade lubricants. Various characteristics of these materials, including molecular weight, may be controlled at levels suitable for use at treat levels necessary to impact the viscosity of the lubricating composition in the desired way.

Conventional ethylene-olefin copolymers at typical treat levels (0.1% to 2% by weight) do not solve the problem of inlet valve deposits (IVD) in direct injection engines. The present invention provides a lubricating composition with a relatively small amount (from 0.005 up to 1.0 or 0.5 or even 0.1% by weight) of high molecular weight polyolefin that reduces IVD.

Historically, metal-containing detergents have been used to improve deposit control. However, in GDI engines, increased levels of detergent metal (or ash) results in higher levels of inlet valve deposits. Metal-containing detergents are necessary in a lubricant to provide basicity (known as TBN) to control corrosion, wear, and other degradation pathways. It has been discovered that the use of high molecular weight polyolefins, especially polyisobutylene, in combination with metal-containing detergents in the lubricant composition results in reduced oil misting and reduced IVD and allows for the use of higher levels of ash-containing detergents.

SUMMARY OF THE INVENTION

The present invention provides a lubricating composition containing an oil of lubricating viscosity, an olefin polymer, and an overbased metal containing detergent, wherein the polymer has a number average molecular weight of at least 20,000, and where the polymer is substantially free of ethylene-derived blocks or even completely free of such blocks.

The invention further provides a lubricant composition comprising (a) an oil of lubricating viscosity, (b) a polyolefin of number average molecular weight at least 20,000, wherein the polymer comprises 0 to 20 percent by weight of ethylene-derived monomer units, said polyolefin being present in an amount of 0.005% to 1.0% by weight of the composition, and (c) an overbased metal-containing detergent.

The invention further provides for lubricant compositions as described above where the composition contains no more than 1200 ppm phosphorus, has a sulfur content of no more than 0.4% by weight, and, in certain embodiments, has a sulfated ash content of no more than 1.0 percent by weight.

The invention further provides a method of lubricating an internal combustion engine, and in some embodiments a four stroke engine. Such methods include the step of supplying to the engine any of the lubricant compositions described herein.

The invention further provides for a method of improving at least one of deposit control or oil misting in an internal combustion engine, said method including the step of supplying any of the lubricant compositions described herein to said engine.

DETAILED DESCRIPTION OF THE INVENTION

Various preferred features and embodiments will be described below by way of non-limiting illustration.

The present invention provides a lubricating composition comprising (a) an oil of lubricating viscosity, (b) an olefin polymer, and (c) an overbased metal containing detergent, wherein the number average molecular weight of the polymer is at least 20,000, and wherein the polymer is has less than 20 percent of or is substantially free of ethylene-derived monomer units. In some embodiments component (b) is present in the composition from 0.005 to 1.0 percent by weight of the entire lubricant composition.

Oil of Lubricating Viscosity

One component of the disclosed technology is an oil of lubricating viscosity. The base oil used in the inventive lubricating oil composition may be selected from any of the base oils in Groups I-V as specified in the American Petroleum Institute (API) Base Oil Interchangeability Guidelines. The five base oil groups are as follows:

| Base Oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAO) | | | |
| Group V | All others not included in Groups I, II, III, or IV | | | |

In one embodiment, the base oil as used in the present technology has less than 300 ppm sulfur and/or at least 90% saturate content, by ASTM D2007. In certain embodiments, the base oil has a viscosity index of at least 95 or at least 115. In one embodiment, the base oil of the invention has a viscosity index of at least 120, is a polyalphaolefin, or is comprised of mixtures of such materials.

Groups I, II and III are mineral oil base stocks. The oil of lubricating viscosity, then, can include natural or synthetic lubricating oils and mixtures thereof. Mixture of mineral oil and synthetic oils, particularly polyalphaolefin oils and polyester oils, are often used. In one embodiment, the oil of lubricating viscosity comprises an API Group III or Group IV oil or mixtures thereof.

Natural oils include animal oils and vegetable oils (e.g. castor oil, lard oil, and other vegetable acid esters) as well as mineral lubricating oils such as liquid petroleum oils and solvent-treated or acid treated mineral lubricating oils of the paraffinic, naphthenic, or mixed paraffinic-naphthenic types. Hydrotreated or hydrocracked oils are included within the scope of useful oils of lubricating viscosity.

Oils of lubricating viscosity derived from coal or shale are also useful. Synthetic lubricating oils include hydrocarbon oils and halosubstituted hydrocarbon oils such as polymerized and interpolymerized olefins and mixtures thereof, alkylbenzenes, polyphenyl, (e.g., biphenyls, terphenyls, and alkylated polyphenyls), alkylated diphenyl ethers and alkylated diphenyl sulfides and their derivatives, analogs and homologues thereof. Alkylene oxide polymers and interpolymers and derivatives thereof, and those where terminal hydroxyl groups have been modified by, for example, esterification or etherification, constitute other classes of known synthetic lubricating oils that can be used. Another suitable class of synthetic lubricating oils that can be used comprises the esters of dicarboxylic acids and those made from C5 to C12 monocarboxylic acids and polyols or polyol ethers.

Other suitable synthetic lubricating oils include liquid esters of phosphorus-containing acids, polymeric tetrahydrofurans, silicon-based oils such as the poly-alkyl-, polyaryl-, polyalkoxy-, or polyaryloxy-siloxane oils, and silicate oils.

Hydrotreated naphthenic oils are also known and can be used. Synthetic oils may be used, such as those produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gasto-liquid oils.

Unrefined, refined and rerefined oils, either natural or synthetic (as well as mixtures of two or more of any of these) of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

The amount of oil in a fully formulated lubricant will typically be the amount remaining to equal 100 percent after the remaining additives are accounted for. Typically this may be 60 to 99 percent by weight, or 70 to 97 percent, or 80 to 95 percent, or 85 to 93 percent. The disclosed technology may also be delivered as a concentrate, in which case the amount of oil is typically reduced and the concentrations of the other components are correspondingly increased. In such cases the amount of oil may be 30 to 70 percent by weight or 40 to 60 percent.

Olefin Polymer

The lubricating composition of the invention contains a high molecular weight olefin polymer that is substantially free of ethylene-derived monomer units (that is, ethylene monomer-derived units). In one embodiment, the polymer may be prepared by polymerizing an alpha-olefin monomer, or mixtures of alpha-olefin monomers, or mixtures comprising ethylene and at least one $C_3$ to $C_{28}$ alpha-olefin monomer, in the presence of a catalyst system comprising at least one metallocene (e.g., a cyclopentadienyl-transition metal compound) and an alumoxane compound.

By substantially free, it is meant that the polymer contains less than 20% by weight polymerized ethylene units, that is, ethylene-derived monomer units. In other embodiments the polymer is less than 10%, 5%, or 2% by weight ethylene units. In one embodiment, the polymer is free of ethylene; this is not to say that trace amounts of ethylene may be present resulting from contamination of desired monomers. In other embodiments, small amounts of ethylene units, such as 0.1% or 0.5% or 1% may also be present.

In one embodiment the monomers from which the polymer is derived has less than 10% ethylene, less than 5% ethylene, less than 1% ethylene, or is free of or substantially free of ethylene. The olefin polymer of the invention may be a homopolymer or a copolymer. In some embodiments the polymer is derived from polymerization of one or more olefins having 3 to 12, such as 4 to 8, carbon atoms. In other embodiments the olefin is butene, such as isobutene (or isobutylene).

Another useful class of polymers is that constituted by polymers prepared by cationic polymerization of, e.g., isobutene or styrene. Common polymers from this class include polyisobutenes obtained by polymerization of a $C_4$ refinery stream having a butene content of 35 to 75 mass %, and an isobutene content of 30 to 60 mass %, in the presence of a Lewis acid catalyst such as aluminum trichloride or boron trifluoride, aluminum trichloride being suitable. Suitable sources of monomer for making poly-n-butenes are petroleum feedstreams such as raffinate II. These feedstocks are disclosed in the art such as in U.S. Pat. No. 4,952,739. Polyisobutylene is a suitable polymer for the present invention because it is readily available by cationic polymerization from butene streams (e.g., using $AlCl_3$ or $BF_3$ catalysts).

It is known that polyisobutylene can be prepared by cationic polymerization with the aid of boron halides, in particular boron trifluoride (E.P.-A 206 756, U.S. Pat. No. 4,316,973, GB-A 525 542 and GB-A 828 367). The polymerization of the isobutylene can be controlled so that polyisobutylenes having number average molecular weights (Mn) far higher than 1,000,000 can be obtained.

In one embodiment the olefin polymer is a copolymer of olefins with 4 or more carbon atoms. In one embodiment, the olefin polymer (polyolefin) comprises 50 to 100% by weight of units derived from at least one olefin monomer having four or more carbon atoms. In typical embodiments the olefins may be unsaturated aliphatic hydrocarbons such as butene, isobutylene (or isobutene), butadiene, isoprene, or combinations thereof.

The polyolefin polymer of the present invention may have a number average molecular weight (by gel permeation chromatography, polystyrene standard) of 20,000 to 10,000,000; 100,000 to 1,500,000; or 200,000 to 1,000,000. In other embodiments the olefin polymer is polyisobutylene with number average molecular weight of at least 50,000, at least 100,000, or at least 250,000 up to 850,000, 600,000, or 500,000. Specific ranges include 250,000 to 750,000 or 250,000 to 500,000.

The polymer can be present on a weight basis in the lubricant composition of this invention at 0.001 to 1%, or 0.003 to 0.8%, or 0.005 to 0.5%, or 0.01 to 0.1%, or 0.02% to 0.05%.

Examples of suitable olefin polymers include ADDCO™ ADDTAC, available from The Lubrizol Corporation, Paratac® (a high molecular weight polyisobutylene tackifier) by Infineum International Ltd., and Oppanol® 150, a high Mw polyisobutylene from BASF (Mn of 425,000).

Overbased Metal-Containing Detergent

The lubricating composition of the invention contains one or more overbased detergents. Overbased materials otherwise referred to as overbased or superbased salts, are generally single phase, homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, such as carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a calcium chloride, acetic acid, phenol or alcohol. The acidic organic material will normally have a sufficient number of carbon atoms to provide a degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 3.5 times as much metal as present in a normal salt will have metal excess of 3.5 equivalents, or a ratio of 4.5. The term "metal ratio is also explained in standard textbook entitled "Chemistry and Technology of Lubricants," Second Edition, Edited by R. M. Mortier and S. T. Orszulik, Copyright 1997.

The metal of the metal-containing detergent may be zinc, sodium, calcium, barium, or magnesium, or mixtures thereof. Typically the metal of the metal-containing detergent may be sodium, calcium, or magnesium, and, in one embodiment, calcium.

The overbased metal-containing detergent may be selected from the group consisting of non-sulfur containing phenates, sulfur containing phenates, sulfonates, salixarates, salicylates, and mixtures thereof, or borated equivalents thereof. In one embodiment, the overbased detergent comprises a calcium sulfonate with a metal ratio of at least 3.5. Sulfonate detergents, including overbased calcium sulfonate detergents are described in numerous publications including US Patent Application 2005065045 and U.S. Pat. No. 5,037,565.

In one embodiment, the overbased detergent comprises a phenol-based detergent, which may be overbased. The term "phenol-based detergent" encompasses sulfur-containing and non-sulfur-containing phenates and other detergents that have a phenolic (i.e., hydroxyaromatic) structure, including salicylates, salixarates, and saligenins. Overbased salicylate detergents and their methods of preparation are disclosed in U.S. Pat. Nos. 4,719,023 and 3,372,116. Salixarate detergents (derivatives) and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate." Saligenin detergents are described in U.S. Pat. No. 6,310,009. The overbased detergent, of whatever type, may be borated with a borating agent such as boric acid.

The overbased metal-containing detergent may also include "hybrid" detergents formed with mixed surfactant systems including phenate and/or sulfonate components, e.g. phenate-salicylates, sulfonate-phenates, sulfonate-salicylates, sulfonates-phenates-salicylates, as described; for example, in U.S. Pat. Nos. 6,429,178; 6,429,179; 6,153,565; and 6,281,179. Where, for example, a hybrid sulfonate-phenate detergent is employed, the hybrid detergent would be considered equivalent to amounts of distinct phenate and sulfonate detergents introducing like amounts of phenate and sulfonate soaps, respectively.

In one embodiment the overbased metal-containing detergent may be zinc, sodium, calcium or magnesium salts of a phenate, sulfur containing phenate, sulfonate, salixarate or salicylate. Overbased salixarates, phenates, and salicylates typically have a total base number (ASTM D3896) of 180 to 450 TBN. Overbased sulfonates typically have a total base number of 250 to 600, or 300 to 500. Overbased detergents are known in the art. In one embodiment the sulfonate detergent may be a predominantly linear alkylbenzene or alkyltoluene sulfonate detergent having a metal ratio of at least 8 as is described in paragraphs [0026] to [0037] of US Patent Application 2005-065045. The predominantly linear alkyl group may be attached to the benzene or toluene at any location along the linear alkyl chain, such as at the 2, 3, or 4 position. The predominantly linear alkylbenzene sulfonate detergent may be particularly useful for assisting in improving fuel economy.

In one embodiment the overbased metal-containing detergent is calcium or magnesium overbased detergent. In one embodiment, the lubricating composition comprises an overbased calcium sulfonate, an overbased calcium phenate, or mixtures thereof. The overbased detergent may comprise calcium sulfonate with a metal ratio of at least 3.5, such as 3.5 to 40 or 5 to 25 or 7 to 20.

In one embodiment, the lubricant composition further comprises a low overbased detergent (metal ratio of less than 3.5, e.g., 0 to 3.5 or 0.5 to 3.0 or 1 to 2.5 or 1.5 to 2) or a neutral detergent.

The overbased detergent of the invention may be present in an amount from 0.05% by weight to 5% by weight of the composition. In other embodiments the overbased detergent may be present from 0.1%, 0.3%, or 0.5% up to 3.2%, 1.7%, or 0.9% by weight of the lubricating composition. Similarly, the overbased detergent may be present in an amount suitable to provide from 1 TBN to 10 TBN to the lubricating composition. In other embodiments the overbased detergent is present in amount which provides from 1.5 TBN up to 3 TBN, 5 TBN, or 7 TBN to the lubricating composition.

Metal-containing detergents, in addition to TBN, also provide ash to the lubricant composition. Sulfated ash (ASTM D874) is another parameter often used to characterize overbased detergents and lubricant compositions. Certain of the compositions of the present invention can have sulfated ash levels of 0.3 to 1.2% or 0.3 to 1.0% or 0.5 to 1.0%, or greater than 0.6%. In other embodiments (e.g., for marine diesel cylinder lubricants) the ash level may be 1 to 15% or 2 to 12% or 4 to 10%. In one embodiment, overbased detergent accounts 50% to 100% of the sulfated ash, at least 70% of the ash, at 80% of the ash, or 100% of the ash. In one embodiment, the overbased detergent provides for no more than 95% of the sulfated ash or no more than 98% of the sulfated ash.

In one embodiment the lubricating composition is a marine diesel cylinder lubricant (MDCL). Lubricants of this type are characterized by very high TBN levels delivered primarily by metal containing overbased detergents. In some embodiments, the lubricant composition will have a TBN of at least 10 or at least 20, e.g., 10-100, 20-100, 30-100, 40-80, 30-75, or 40-70. Most of the basicity of the MDCL composition may be contributed by the detergent component, although typically a relatively small amount (e.g., less than 5%) of the TBN may be contributed by other species such as nitrogen-containing dispersants (described below). In the present MDCL fluid, a large portion of the TBN is provided by one or more metal detergents, such as 90 to 100 percent, or 95 to 100 percent, or 98 to 99 percent of the TBN. The foregoing amounts of TBN may be provided by one or more calcium detergents, and in one embodiment one or more calcium overbased detergents. Thus, in various embodiments, 40 to 90 percent of the detergent TBN may be from one or more calcium detergents, or 50 to 90 percent, or 55 to 85 percent, or 60 to 80 percent, or 60 to 75 percent, or 90 to 100 percent or 95 to 100 percent or 98 to 99 percent. In other applications, the detergent component may contribute a relatively smaller amount of the TBN of the lubricant, such as 40 to 90 percent, or 45 to 80 percent, or 50 to 70 percent.

Other Performance Additives

A lubricating composition may be prepared by adding the product of the process described herein to an oil of lubricating viscosity, optionally in the presence of other performance additives (as described hereinbelow).

The lubricating composition of the invention optionally comprises other performance additives. The other performance additives include at least one of metal deactivators, additional viscosity modifiers, additional detergents, friction modifiers, antiwear agents, corrosion inhibitors, dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

Antioxidants include sulfurized olefins, diarylamines or alkylated diarylamines, hindered phenols, molybdenum compounds (such as molybdenum dithiocarbamates), hydroxylthioethers, or mixtures thereof. In one embodiment the lubricating composition includes an antioxidant, or mixtures thereof. The antioxidant may be present at 0 wt % to 15 wt %, or 0.1 wt % to 10 wt %, or 0.5 wt % to 5 wt %, or 0.5 wt % to 3 wt % of the lubricating composition.

The diarylamine or alkylated diarylamine may be phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the diphenylamine may include nonyl diphenylamine, or dinonyl diphenylamine. The alkylated diarylamine may include octyl, di-octyl, nonyl, di-nonyl, decyl or di-decyl phenylnapthylamines.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. Such materials may be represented by the general formula

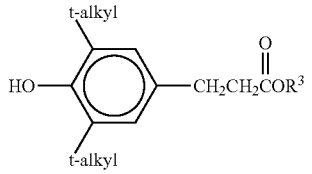

wherein $R^3$ is a hydrocarbyl group such as an alkyl group containing, e.g., 1 to 18 or 2 to 12 or 2 to 8 or 2 to 6 carbon atoms; and t-alkyl can be t-butyl. A more detailed description of suitable ester-containing hindered phenol antioxidant chemistry is found in U.S. Pat. No. 6,559,105.

Examples of molybdenum dithiocarbamates which may be used as an antioxidant include commercial materials sold under the trade names such as Vanlube 822™ and Molyvan™ A from R. T. Vanderbilt Co., Ltd., and Adeka Sakura-Lube™ S-100, S-165, S-525 and S-600 from Asahi Denka Kogyo K. K and mixtures thereof.

In one embodiment the lubricating composition further includes a viscosity modifier. Viscosity modifiers are known in the art and may include hydrogenated styrene-butadiene rubbers, ethylene-olefin copolymers (especially ethylene-propylene), polymethacrylates, polyacrylates, hydrogenated styrene-isoprene polymers, hydrogenated diene polymers, poly(alkyl styrenes), polyolefins, esters of maleic anhydride-olefin copolymers (such as those described in International Application WO 2010/014655), esters of maleic anhydride-styrene copolymers, or mixtures thereof.

The dispersant viscosity modifier may include functionalized polyolefins, for example, ethylene-propylene copolymers that have been functionalized with an acylating agent such as maleic anhydride and an amine; polymethacrylates functionalized with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples described in paragraphs [0065] to [0073]).

In one embodiment the lubricating composition of the invention further comprises a dispersant viscosity modifier. The dispersant viscosity modifier may be present at 0 wt % to 15 wt %, or 0 wt % to 10 wt %, or 0.05 wt % to 5 wt %, or 0.2 wt % to 2 wt % of the lubricating composition.

The lubricating composition may further include a dispersant, or mixtures thereof. The dispersant may be a succinimide dispersant, a Mannich dispersant, a succinamide dispersant, a polyolefin succinic acid ester, amide, or ester-amide, or mixtures thereof. In one embodiment the dispersant may be present as a single dispersant. In one embodiment the dispersant may be present as a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine (i.e., a poly(ethyleneamine)), a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetraethylenepentamine, pentaethylene-hexamine, polyamine still bottoms, and mixtures thereof.

The succinimide dispersant may be derived from an aromatic amine, aromatic polyamine, or mixtures thereof. The aromatic amine may have one or more aromatic moieties linked by a hydrocarbylene group and/or a heteroatom. In certain embodiments, the aromatic amine may be a nitro-substituted aromatic amine. Examples of nitro-substituted aromatic amines include 2-nitroaniline, 3-nitroaniline, and 4-nitroaniline. 3-nitroaniline is particularly useful. Other aromatic amines may be present along with the nitroaniline. Condensation products with nitroaniline and optionally also with Disperse Orange 3 (that is, 4-(4-nitrophenylazo)aniline) are known from US Patent Application 2006-0025316, Covitch et al., published Feb. 2, 2006.

In certain embodiments, the dispersant comprises a polymer functionalized with a certain type of amine, e.g., a succinimide dispersant. The amine used for the polymeric dispersant may be an amine having at least 2 or at least 3 or at least 4 aromatic groups, for instance, 4 to 10 or 4 to 8 or 4 to 6 aromatic groups, and at least one primary or secondary amino group or, alternatively, at least one secondary amino group. In some embodiments the amine comprises both a primary and at least one secondary amino group. In certain embodiments, the amine comprises at least 4 aromatic groups and at least 2 secondary or tertiary amino groups.

An example of an amine having 2 aromatic groups is N-phenyl-p-phenylenediamine. An example of an amine having at least 3 or 4 aromatic groups may be represented by Formula (I):

Formula 1

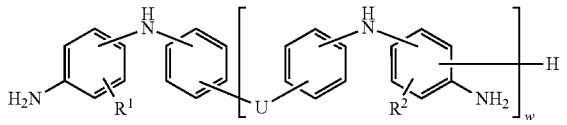

wherein, independently, each variable is as follows: $R^1$ may be hydrogen or a $C_{1-5}$ alkyl group (typically hydrogen); $R^2$ may be hydrogen or a $C_{1-5}$ alkyl group (typically hydrogen); U may be an aliphatic, alicyclic or aromatic group (when U is aliphatic, the aliphatic group may be a linear or branched alkylene group containing 1 to 5, or 1 to 2 carbon atoms); and w may be 1 to 10, or 1 to 4, or 1 to 2 (typically 1). In one embodiment, when U is an aliphatic group, U is in particular an alkylene groups containing 1 to 5 carbon atoms. Alternatively, the amine may also be represented by Formula (Ia)

Formula (1a)

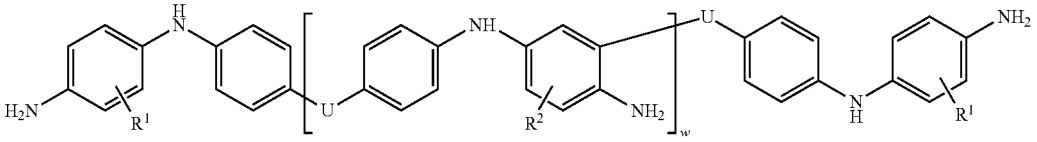

wherein each variable U, $R^1$, and $R^2$ are the same as described above and w is 0 to 9 or 0 to 3 or 0 to 1 (typically 0).

In one embodiment the dispersant may be a polyolefin succinic acid ester, amide, or ester-amide. For instance, a polyolefin succinic acid ester may be a polyisobutylene succinic acid ester of pentaerythritol, or mixtures thereof. A polyolefin succinic acid ester-amide may be a polyisobutylene succinic acid reacted with an alcohol (such as pentaerythritol) and an amine (such as a diamine, typically diethyleneamine).

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulfide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid.

The dispersant may be present at 0.01 wt % to 20 wt %, or 0.1 wt % to 15 wt %, or 0.1 wt % to 10 wt %, or 1 wt % to 6 wt %, or 1 to 3 wt % of the lubricating composition.

In one embodiment the friction modifier may be selected from the group consisting of long chain fatty acid derivatives of amines, long chain fatty esters, or derivatives of a long chain fatty epoxides; fatty imidazolines; amine salts of alkylphosphoric acids; fatty alkyl tartrates; fatty alkyl tartrimides; fatty alkyl tartramides; fatty glycolates; and fatty glycolamides. As used herein the term "fatty alkyl or fatty" in relation to friction modifiers means a carbon chain having 10 to 22 carbon atoms, typically a straight carbon chain. The friction modifier may be present at 0 wt % to 6 wt %, or 0.01 wt % to 4 wt %, or 0.05 wt % to 2 wt %, or 0.1 wt % to 2 wt % of the lubricating composition.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulfurized fatty compounds and olefins, molybdenum dialkyldithiophosphates, molybdenum dithiocarbamates, and monoesters of a polyol and an aliphatic carboxylic acid derived or derivable from sunflower oil or soybean oil.

In one embodiment the friction modifier may be a long chain fatty acid ester. In another embodiment the long chain fatty acid ester may be a mono-ester and in another embodiment the long chain fatty acid ester may be a (tri)glyceride.

The lubricating composition optionally further includes at least one antiwear agent. Examples of suitable antiwear agents include tartrates, tartrimides, oil soluble amine salts of phosphorus compounds, sulfurized olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The antiwear agent may, in one embodiment, include a tartrate, or tartrimide as disclosed in International Publication WO 2006/044411 or Canadian Patent CA 1 183 125. The tartrate or tartrimide may contain alkyl-ester groups, where the sum of carbon atoms on the alkyl groups is at least 8.

Another class of additives includes oil-soluble titanium compounds as disclosed in U.S. Pat. No. 7,727,943 and U.S. Application 2006/0014651. The oil-soluble titanium compounds may function as antiwear agents, friction modifiers, antioxidants, deposit control additives, or more than one of these functions. In one embodiment the oil soluble titanium compound is a titanium (IV) alkoxide. The titanium alkoxide is formed from a monohydric alcohol, a polyol or mixtures thereof. The monohydric alkoxides may contain from 2 to 16 carbon atoms, or from 3 to 10 carbon atoms. In one embodiment, the titanium alkoxide is titanium (IV) isopropoxide. In one embodiment, the titanium alkoxide is titanium (IV) 2-ethylhexoxide. In one embodiment, the titanium compound comprises the alkoxide of a vicinal 1,2-diol or polyol. In one embodiment, the 1,2-vicinal diol comprises a fatty acid mono-ester of glycerol, such as oleic acid.

In one embodiment, the oil soluble titanium compound is a titanium carboxylate. The titanium carboxylate may be derived from a titanium alkoxide and a carboxylic acid selected from the group consisting of a non-linear mono-carboxylic acid and a carboxylic acid having more than 22 up to 25 carbon atoms. Examples of titanium/carboxylic acid products include, but are not limited to, titanium reaction products with acids selected from the group consisting of caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like. Methods for making such titanium/carboxylic acid products are described, for example, in U.S. Pat. No. 5,260,466.

Extreme Pressure (EP) agents that are soluble in the oil include sulfur- and chlorosulfur-containing EP agents, dimercaptothiadiazole or $CS_2$ derivatives of dispersants (typically succinimide dispersants), derivative of chlorinated hydrocarbon EP agents and phosphorus EP agents. Examples of such EP agents include chlorinated wax; sulfurized olefins (such as sulfurized isobutylene), a hydrocarbyl-substituted 2,5-dimercapto-1,3,4-thiadiazole, or oligomers thereof, organic sulfides and polysulfides such as dibenzyldisulfide, bis-(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described in U.S. Pat. No. 3,197,405).

Foam inhibitors that may be useful in the compositions of the invention include copolymers of ethyl acrylate, polysiloxanes and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene copolymers, poly(meth)acrylates, polyacrylates or polyacrylamides.

Demulsifiers include trialkyl phosphates, and various polymers and copolymers of ethylene glycol, ethylene oxide, propylene oxide, or mixtures thereof.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Seal swell agents include sulfolene derivatives Exxon Necton-37™ (FN 1380) and Exxon Mineral Seal Oil™ (FN 3200).

INDUSTRIAL APPLICATION

The presently-described lubricants may be used to lubricate a mechanical device, by supplying the lubricant as described herein to the device. The device may be an internal combustion engine such as a gasoline-fired or diesel-fired automobile engine, a heavy duty diesel engine, a marine diesel engine, or a stationary gas engine. Such engines may be sump lubricated, and the lubricant may be provided to the sump from whence it may lubricate the moving parts of the engine. Alternatively, the lubricant may be supplied from a separate source, not a part of a sump.

In one embodiment the internal combustion engine may be a diesel fueled engine (typically a heavy duty diesel engine), a gasoline fueled engine, a natural gas fueled engine, a mixed gasoline/alcohol fueled engine, or a hydrogen fueled internal combustion engine. In one embodiment the internal combustion engine may be a diesel fueled engine and in another embodiment a gasoline fueled engine. In one embodiment the internal combustion engine may be a heavy duty diesel engine.

The internal combustion engine may be a 2-stroke or 4-stroke engine. Suitable internal combustion engines include marine diesel engines (which may comprise a cylinder which is lubricated with said lubricant), aviation piston engines, low-load diesel engines, and automobile and truck engines. The marine diesel engine may be lubricated with a marine diesel cylinder lubricant (typically in a 2-stroke engine), a system oil (typically in a 2-stroke engine), or a crankcase lubricant (typically in a 4-stroke engine).

One class of internal combustion engines is direct injected combustion engines wherein the fuel is injected directly into the cylinder. Specific examples of direct injection include wall guided and spray guided direct injection engines. In one embodiment, the lubricant composition is used to lubricate a gasoline direct injection engine.

The lubricant composition for an internal combustion engine may be suitable for any engine lubricant irrespective of the sulfur, phosphorus or sulfated ash content. The sulfur content of the engine oil lubricant may be 1 wt % or less, or 0.8 wt % or less, or 0.5 wt % or less, or 0.3 wt % or less. In one embodiment the sulfur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or 0.06 wt % or less, 0.055 wt % or less, or 0.05 wt % or less. In one embodiment the phosphorus content may be 0.4 wt % to 0.12 wt %. In one embodiment the phosphorus content may be 100 ppm to 1000 ppm, or 200 ppm to 600 ppm. In certain embodiments, the total sulfated ash content may be 0.3 wt % to 1.2 wt %, or 0.5 wt % to 1.1 wt % of the lubricating composition. In one embodiment the sulfated ash content may be 0.5 wt % to 1.1 wt % of the lubricating composition.

In one embodiment the lubricating composition may be an engine oil, wherein the lubricating composition may be characterized as having at least one of (i) a sulfur content of 0.5 wt % or less, (ii) a phosphorus content of 0.12 wt % or less, and (iii) a sulfated ash content of 0.5 wt % to 1.1 wt % of the lubricating composition.

In another embodiment, the lubricant composition is a marine diesel cylinder lubricant, which may be used, accordingly, to lubricate a marine diesel cylinder. In one embodiment, the marine diesel cylinder is within a 2-stroke marine diesel engine. Marine diesel cylinder lubricants are typically used for one pass and are consumed, rather than being retained in a sump. Such lubricants typically require a high detergent level, imparting high levels of basicity as measured by Total Base Number (TBN) to the lubricant, typically resulting in TBN levels of 20 or greater, such as 30 or greater, such as 40 or greater, 50 or greater, or 70 or greater, and typically up to 100 or to 300 or to 80.

In certain embodiments the lubricant may be used in a method of reducing inlet valve deposits in direct injection gasoline engines, or reducing oil misting in direct injection gasoline engines or in marine diesel engines, in particular, the cylinders thereof, by supplying the lubricant described herein.

EXAMPLES

The invention will be further illustrated by the following examples. While the examples are provided to illustrate the present invention, they are not intended to limit it.

Polymer 1 is a commercially available anti-mist additive. The polymer is a high molecular weight polyisobutylene (Mn 366,000, polystyrene standard) and is supplied as a concentrate of 3% polymer in oil. Polymer 2 is a commercially available polyisobutylene (Mn 368,000), supplied as a concentrate of 6.5% polymer in oil.

A series of 5W-30 engine lubricants in base oil of lubricating viscosity containing conventional viscosity modifiers are prepared containing ashless succinimide dispersant, overbased calcium sulfonate and calcium phenate detergents, antioxidants (combination of phenolic ester and diarylamine), zinc dialkyldithiophosphate (ZDDP), as well as other performance additives as follows:

TABLE 1

Additive Composition

| Component | Treat Rate, % (Oil free) |
|---|---|
| Succinimide dispersant | 6.2 |
| Ashless Antioxidant | 3.6 |
| Overbased Calcium Phenate | 0.9 |
| Overbased Calcium Sulfonate | 0.12 |
| ZDDP | 0.76 |
| Corrosion Inhibitor | 0.12 |
| Friction Modifier | 0.05 |
| Foam Inhibitor | 0.01 |
| Diluent Oil | Balance to 14% |

The 5W-30 lubricants are evaluated in the Volkswagen FSi test. The VW FSi test is a direct injection engine test designed to measure Inlet Valve deposits. The test is carried out on a 1.4 L direct injection gasoline engine from according to Volkswagen test procedure PV1481.

TABLE 2

Lubricant Composition

| | Comparative Ex 1 | Inventive Ex 1 |
|---|---|---|
| Vis grade | 5W-30 | 5W-30 |
| Base Oil | Gp III/PAO | Gp III/PAO |
| Hydrogenated Styrene-Diene VI Improver | 1.1 | 1.1 |
| PPD | 0.2 | 0.2 |
| Additive % | 14* | 14* |
| Polymer 1 (oil free basis) | 0 | 0.03 |
| Sulfated Ash | 0.74 | 0.74 |
| % P | 0.076 | 0.076 |
| % S | 0.221 | 0.221 |
| Results: | | |
| Total inlet valve dep (g)** | 1.228, 1.163 (2 runs) | 0.790 |

*Summarized in Table 1

**A pass limit that has been established for this test is <0.819

The oil containing the polymer additive gave a significant improvement and reduced IVD by >32% compared to the baseline. The oil containing the polymer additive passed the test while the baseline oil was a clear fail.

At this sulfated ash level, without the addition of the high molecular weight PIB, no passing result is obtained. The need to control acid build-up in the lubricating oil and provide cleanliness and deposit control for other engine systems does not allow significant reduction in the detergent ash level.

Polymers 1 and 2 are evaluated in a lubricant formulation characteristic of a marine diesel cylinder lubricant. The lubricant comprises oil of lubricating viscosity and 14% of a conventional additive mixture for MDCL, including succinimide dispersant, overbased calcium detergents, and diluent oil. To the lubricant is added an amount of Polymer 1 or Polymer 2 (percent, on an oil-free basis) as indicated in the Table 3, below.

The susceptibility of lubricants treated with the polymers to weight loss by misting is tested. To a 3-neck round-bottom flask is added 170.00 g of the lubricant formulation to be tested, and the flask heated to 149° C. At this point, an air flow is directed into the oil, delivering 20 L/min of air. After 4 hours, the flow is discontinued and the flask is allowed to cool and is then weighed. The weight loss (% misting loss) of the lubricant formulation is calculated and is presented in Table 3:

TABLE 3

| Example | Polymer 1 | Polymer 2 | % Misting Loss |
|---|---|---|---|
| Comparative Ex. 2 | 0 | 0 | 15.2 |
| Inventive Ex. 2 | 0.0015 | — | 11.3 |
| Inventive Ex 3 | 0.003 | — | 10.7 |
| Inventive Ex 4 | — | 0.0033 | 10.4 |
| Inventive Ex 5 | — | 0.0065 | 10.0 |
| Inventive Ex 6 | 0.012 | — | 9.4 |
| Inventive Ex 7 | — | 0.026 | 9.7 |

The results show that amounts at least as low as 0.0015 percent by weight of the polymer can lead to significant reduction in misting of the lubricant.

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration. Unless otherwise noted, all percent values and ppm values are presented on a weight basis and are in relation to the overall composition. Unless otherwise noted, all ranges, percentages, etc for a given component is provided on an oil-free, or actives, basis that does not include any diluent oil or similar material that may be present in a commercial version of the component in question.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is found in paragraphs [0118] to [0119] of International Publication WO2008147704.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The invention claimed is:

1. A method of lubricating a sump-lubricated four stroke internal combustion engine, comprising supplying thereto a lubricant composition comprising (a) an oil of lubricating viscosity, (b) a polyolefin of number average molecular weight at least about 20,000, wherein the polyolefin comprises 0 to about 20 percent by weight of ethylene-derived monomer units, said polyolefin being present in an amount of about 0.001% to about 1.0% by weight of the composition, and (c) an overbased metal containing detergent.

2. The method of claim 1 where the polyolefin comprises about 50 to 100% by weight of units derived from at least one olefin monomer having four or more carbon atoms.

3. The method of claim 1 where the polyolefin has a number average molecular weight of at least about 50,000 and comprises isobutylene-derived units.

4. The method of claim 1 where the number average molecular weight of the polyolefin is about 200,000 to about 10,000,000.

5. The method of claim 1 where the overbased detergent comprises a calcium sulfonate with a metal ratio of at least about 3.5.

6. The method of claim 1 wherein the overbased detergent comprises a phenol-based detergent.

7. The method of claim 1 wherein the overbased detergent contributes about 90 percent to about 100 percent of the TBN to the composition.

8. The method of claim 1 wherein the overbased detergent contributes about 40 percent to about 90 percent of the TBN to the composition.

9. The method of claim 1 where the composition has a sulfated ash content of about 0.3% to about 10% by weight.

10. The method of claim 1 wherein the composition has a sulfated ash content of about 0.3% to about 1.0% by weight.

11. The method of claim 1 wherein the lubricant composition further comprises an ashless dispersant, an antiwear agent, an ashless antioxidant, a friction modifier, a viscosity index improver, or a combination thereof.

12. The method of claim 1 wherein the oil of lubricating viscosity comprises an API Group III or Group IV oil or mixtures thereof.

13. The method of claim 1 wherein the internal combustion engine is a direct injection gasoline engine.

14. The method of claim 1 wherein the internal combustion engine is a compression-ignition engine.

15. The method of claim 1 wherein the internal combustion engine is a marine diesel engine comprising a cylinder which is lubricated with said lubricant.

16. A method of reducing inlet valve deposits in a sump lubricated four stroke direct injection gasoline engine comprising supplying to the engine the lubricant composition of claim 1.

17. A method of reducing oil misting in a sump-lubricated four stroke internal combustion engine, comprising supplying to the engine the lubricant composition of claim 1.

18. The method of claim 17 wherein the engine is a marine diesel engine and the lubricant is supplied to the cylinder thereof.

* * * * *